US009994938B2

(12) United States Patent
Sato et al.

(10) Patent No.: US 9,994,938 B2
(45) Date of Patent: Jun. 12, 2018

(54) FE-NI-BASED ALLOY HAVING EXCELLENT HIGH-TEMPERATURE CHARACTERISTICS AND HYDROGEN EMBRITTLEMENT RESISTANCE CHARACTERISTICS, AND METHOD FOR PRODUCING THE SAME

(71) Applicant: THE JAPAN STEEL WORKS, LTD., Shinagawa-ku, Tokyo (JP)

(72) Inventors: Shinya Sato, Muroran (JP); Rinzo Kayano, Muroran (JP); Tatsuya Takahashi, Muroran (JP); Koichi Takasawa, Muroran (JP)

(73) Assignee: THE JAPAN STEEL WORKS, LTD., Tokyo (JP)

( * ) Notice: Subject to any disclaimer, the term of this patent is extended or adjusted under 35 U.S.C. 154(b) by 0 days. days.

(21) Appl. No.: 14/758,375

(22) PCT Filed: Dec. 25, 2013

(86) PCT No.: PCT/JP2013/084757
§ 371 (c)(1),
(2) Date: Jun. 29, 2015

(87) PCT Pub. No.: WO2014/104138
PCT Pub. Date: Jul. 3, 2014

(65) Prior Publication Data

US 2015/0354039 A1 Dec. 10, 2015

(30) Foreign Application Priority Data

Dec. 28, 2012 (JP) ..... 2012-288610

(51) Int. Cl.
*C22C 38/00* (2006.01)
*C21D 6/00* (2006.01)
(Continued)

(52) U.S. Cl.
CPC ..... *C22C 38/00* (2013.01); *C21D 6/004* (2013.01); *C21D 6/005* (2013.01); *C21D 6/02* (2013.01);
(Continued)

(58) Field of Classification Search
CPC ..... C22C 38/50; C22C 38/54; C22C 38/44
See application file for complete search history.

(56) References Cited

U.S. PATENT DOCUMENTS 3,169,858 A 2/1965 Heydt et al.
5,064,610 A * 11/1991 Sato ..... C22C 38/58 148/327
(Continued)

FOREIGN PATENT DOCUMENTS

CN 1095425 A 11/1994
CN 101906595 A 12/2010
(Continued)

OTHER PUBLICATIONS

Thompson et al., "Hydrogen Performance of Precipitation-Strengthened Stainless Steels Based on A-286," Metallurgical Transactions A 6(7), pp. 1431-1442, Jul. 1975.*
(Continued)

*Primary Examiner* — Jessee Roe
(74) *Attorney, Agent, or Firm* — Sughrue Mion, PLLC

(57) ABSTRACT

The present invention relates to an Fe—Ni-based alloy having excellent high-temperature characteristics and hydrogen embrittlement resistance, which has a composition containing, in terms of % by mass, C: 0.005% to 0.10%, Si: 0.01% to 0.10%, P: 0.015% or less, S: 0.003% or less, Ni: 23.0% to 27.0%, Cr: 12.0% to 16.0%, Mo: 0.01% or less, Nb: 0.01% or less, W: 2.5% to 6.0%, Al: 1.5% to 2.5%, and Ti: 1.5% to 2.5%, the balance being Fe and other unavoidable impurities.

5 Claims, 4 Drawing Sheets

(51) Int. Cl.

| | |
|---|---|
| ***C22C 38/48*** | (2006.01) |
| ***C21D 6/02*** | (2006.01) |
| ***C22C 38/50*** | (2006.01) |
| ***C22C 38/54*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |

(52) U.S. Cl.

CPC ..... *C22C 38/004* (2013.01); *C22C 38/02* (2013.01); *C22C 38/04* (2013.01); *C22C 38/06* (2013.01); *C22C 38/44* (2013.01); *C22C 38/48* (2013.01); *C22C 38/50* (2013.01); *C22C 38/54* (2013.01); *C21D 6/008* (2013.01)

(56) References Cited

U.S. PATENT DOCUMENTS

| | | | | |
|---|---|---|---|---|
| 5,370,838 | A | 12/1994 | Sato et al. | |
| 6,372,181 | B1 * | 4/2002 | Fahrmann | C22C 19/058 148/442 |
| 2004/0089701 | A1 * | 5/2004 | Tezuka | C21D 1/28 228/233.2 |

FOREIGN PATENT DOCUMENTS

| | | | |
|---|---|---|---|
| EP | 0838533 | A1 | 4/1998 |
| JP | 58-34129 | A | 2/1983 |
| JP | 60-46353 | A | 3/1985 |
| JP | 11-107720 | A | 4/1999 |
| JP | H 11-106871 | A | 4/1999 |
| JP | H 11-107720 | A | 4/1999 |
| JP | 2000-204449 | A | 7/2000 |
| JP | 2000204449 | A | 7/2000 |
| JP | 2001158943 | A | 6/2001 |
| JP | 2005-2451 | A | 1/2005 |
| JP | 2008-144237 | A | 6/2008 |
| JP | 2010-133024 | A | 6/2010 |
| JP | 2011-68919 | A | 4/2011 |

OTHER PUBLICATIONS

Bruemmer et al., "Influence of sulfur, phosphorus, and antimony segregation on the intergranular hydrogen embrittlement of nickel," Metallurgical Transactions A 14(1), pp. 223-232, Feb. 1983.*

Guo et al. ("Effect of boron addition on hydrogen embrittlement sensitivity in Fe—Ni based alloys," Materials Science and Engineering A 527(24-25), pp. 6620-6625, Sep. 2010.*

Sun et al., "Effect of phosphorus on the microstructure and stress rupture properties in an Fe—Ni—Cr base superalloy," Metallurgical and Materials Transactions A 28(3), pp. 649-654, Mar. 1997.*

Communication dated Mar. 2, 2016, issued by the State Intellectual Property Office of the People's Republic of China in counterpart Chinese Patent Application No. 201380086785.X.

Li, et al., "Effects of Grain-Boundary η Phase on the Mechanical Properties of Fe—Ni—Cr Alloy", Acta Metallurgica Sinica, vol. 41, Issue No. 11, Nov. 30, 2005, pp. 1155-1158.

Zhang, et al., "Effects of Grain-Boundary Phases on Hydrogen Embrittlement of Fe—Ni—Cr Austenitic Alloys", Acta Metallurgica Sinica, vol. 44, Issue No. 9, Sep. 30, 2008, pp. 1095-1098.

Yin, et al., "Classification and designation for superalloys and high temperature intermetallic materials", Jul. 21, 2005, 25 pages total.

Anonymous, "Tenth Beijing Metallurgical Youth Science and Technology Outstanding Dissertations", Beijing Metal Society Henan Science and Technology Press, Sep. 30, 2010, 2 pages total.

Chen, H., Miscellaneous comments on communication dated Mar. 2, 2016, issued by the State Intellectual Property Office of the People's Republic of China in counterpart Chinese Patent Application No. 201380086785.X, dated Apr. 6, 2016, 3 pages total.

Search Report dated Mar. 25, 2014 issued in International Application No. PCT/JP2013/084757 (PCT/ISA/210).

Written Opinion dated Mar. 25, 2014 issued in International Application No. PCT/JP2013/084757 (PCT/ISA/237).

Search Report dated Aug. 8, 2016, issued by the European Patent Office in counterpart European Application No. 13868330.5.

Communication dated Oct. 20, 2015 issued by Korean Intellectual Property Office in counterpart Korean Patent Application No. 10-2015-7020471.

* cited by examiner

FE-NI-BASED ALLOY HAVING EXCELLENT HIGH-TEMPERATURE CHARACTERISTICS AND HYDROGEN EMBRITTLEMENT RESISTANCE CHARACTERISTICS, AND METHOD FOR PRODUCING THE SAME

TECHNICAL FIELD

The present invention relates to an Fe—Ni-based alloy capable of being used in a high-temperature and high-pressure environment or a high-pressure hydrogen environment, or an environment where the both are superposed and a method for producing the same.

BACKGROUND ART

As structural materials capable of being used under a high-temperature and high-pressure environment such as 600° C. or higher, an Ni-based alloy and an Fe—Ni-based alloy having excellent high-temperature strength may be mentioned. An Ni-based alloy has an excellent high-temperature tensile strength and creep characteristics and the alloy capable of being used even at a high temperature of 700° C. or higher has been developed and used in power generation plants and jet engine components. However, since an Ni-based alloy tends to cause macroscopic segregation during ingot production, it is considered difficult to produce a large ingot free from segregation. As heat-resistant alloys from which it is relatively easy to produce a large ingot, for example, Inconel (trademark, the same shall apply hereinafter) Alloy 718. Inconel Alloy 706, A286, and the like may be mentioned. These alloys are excellent in productivity of a relatively large ingot and a gas turbine disk or a rotor shaft material for power generation has been produced from an ingot of about 10 tons.

Furthermore, in the case of the use under a high-pressure hydrogen environment, it is necessary to use a material having low susceptibility to hydrogen embrittlement as a structural material of a pressure vessel. Since strength and ductility are remarkably lowered upon hydrogen embrittlement, the lowering of safety becomes a big problem. In general, a material having higher strength exhibits increased susceptibility to hydrogen embrittlement and, in particular, when a harmful precipitated phase is present, it is known that the susceptibility to hydrogen embrittlement greatly increases. As alloys achieving both of hydrogen embrittlement resistance and high strength, there are, for example, those proposed in PTLs 1 and 2. In PTL 1, it is considered that it becomes possible to attain high strength without increasing the susceptibility to hydrogen embrittlement by subjecting JIS SUH 660 steel (hereinafter. A286 alloy) to cold-working. In PTL 2, it is reported that the susceptibility to hydrogen embrittlement can be reduced by defining the upper limit of the area ratio of NbC in an FeNi-based alloy.

CITATION LIST

Patent Literature

PTL 1: JP-A-2011-68919
PTL 2: JP-A-2008-144237

SUMMARY OF INVENTION

Technical Problem

As mentioned above, since the Ni-based alloy tends to cause macroscopic segregation during ingot production, it is difficult to produce a large ingot free from segregation and an ingot size capable of being produced is limited depending on the alloy composition. Therefore, the application to a relatively large structural component is difficult in the current steel making technology.

Although an Fe—Ni-based alloy is inferior to an Ni-based alloy in short-time high-temperature characteristics, there is a possibility that the Fe—Ni-based alloy can be applied to a large structural component to be used at high temperature since the alloy is excellent in productivity of a large ingot. On the other hand, with regard to the susceptibility to hydrogen embrittlement, the characteristics are different among alloys. As for principal alloys, for example, Inconel Alloy 718 is excellent in high-temperature strength but, since a δ phase is precipitated on grain boundaries, it has high susceptibility to hydrogen embrittlement. Since Inconel Alloy 706 has a high Nb content and a precipitated phase harmful to the susceptibility to hydrogen embrittlement is precipitated when aged for a long time, its use as a structural material to be heated at a high temperature for a long time is no suitable. Since A286 does not contain any precipitated phase harmful to the susceptibility to hydrogen embrittlement, it is known to be a material having low susceptibility to hydrogen embrittlement. However, since it is inferior to the aforementioned alloys in high-temperature strength, there is a problem that the use as a structural component leads to a weight increase and a cost increase.

Also, with regard to the high strength attained by cold-working as proposed in PTL 1, since the effect is considered to be lost in the case where it is used in a high-temperature environment, its use is limited to the use at a relatively low temperature. With regard to the method proposed in PTL 2, its effect is not clear in the case where hydrogen concentration exceeds 25 ppm and in the case of the use at a high temperature.

The present invention has been made to solve the problems of the above-mentioned conventional ones, and an object thereof is to provide an Fe—Ni-based alloy having excellent high-temperature characteristics and hydrogen embrittlement resistance, which can be used as a structural component of a large pressure vessel and the like to be used in a high-temperature and high-pressure environment or a high-pressure hydrogen environment, or an environment where the both are superposed, and a method for producing the alloy.

Solution to Problem

That is, in an Fe—Ni-based alloy having excellent high-temperature characteristics and hydrogen embrittlement resistance of the invention, a first aspect of the invention is characterized in that a composition comprises, in terms of % by mass, C: 0.005% to 0.10%, Si: 0.01% to 0.10%, P: 0.015% or less, S: 0.003% or less, Ni: 23.0% to 27.0%, Cr: 12.0% to 16.0%, Mo: 0.01% or less, Nb: 0.01% or less, W: 2.5% to 6.0%. Al: 1.5% to 2.5%, and Ti: 1.5% to 2.5%, the balance being Fe and other unavoidable impurities.

The Fe—Ni-based alloy having excellent high-temperature characteristics and hydrogen embrittlement resistance according to a second aspect of the invention, in the first aspect of the invention, the alloy contains P: 0.003% to 0.015% in terms of % by mass.

The Fe—Ni-based alloy having excellent high-temperature characteristics and hydrogen embrittlement resistance according to a third aspect of the invention, in the first or second aspects of the invention, the composition further contains one or two kinds of B: 0.0020% to 0.0050% and Zr: 0.02% to 0.05%.

The Fe—Ni-based alloy having excellent high-temperature characteristics and hydrogen embrittlement resistance according to a fourth aspect of the invention, in any one of the first to third aspects of the invention, the alloy does not contain an η phase and 15% or more of a γ' phase in terms of a volume ratio in the metal structure.

The Fe—Ni-based alloy having excellent high-temperature characteristics and hydrogen embrittlement resistance according to a fifth aspect of the invention, in any one of the first to fourth aspects of the invention, in a tensile test at 625° C., a hydrogen embrittlement resistance index (reduction of area ratio in the tensile test: hydrogen-charged material/As material) is 0.4 or more.

A method for producing an Fe—Ni-based alloy having excellent high-temperature characteristics and hydrogen embrittlement resistance, which is a sixth aspect of the invention, is characterized in that, after the alloy having the composition according to any of the first to third aspects of the invention is subjected to a solution treatment at 950° C. or higher, the alloy is subjected to a first-stage aging heat treatment in the range of 700 to 800° C. and is then subjected to a second-stage aging heat treatment at a temperature lower than the temperature at the first-stage aging heat treatment in the range of 700 to 800° C.

Advantageous Effects of Invention

As described above, according to the present invention, an Fe—Ni-based alloy having excellent high-temperature strength and hydrogen embrittlement resistance can be produced. Also, since it contains much inexpensive Fe, raw material costs can be reduced as compared with the case of an Ni-based alloy and, since the Fe—Ni-based alloy is based on an Fe—Ni base that is satisfactory in the productivity of a large ingot, the application to a large component becomes possible.

BRIEF DESCRIPTION OF DRAWINGS

FIG. 2(*a*) relates to the test material of Example 1, FIG. 2(*b*) relates to the test material of Comparative Example 2, and FIG. 2(*c*) relates to the test material of Comparative Example 3.

DESCRIPTION OF EMBODIMENTS

Figure 1:
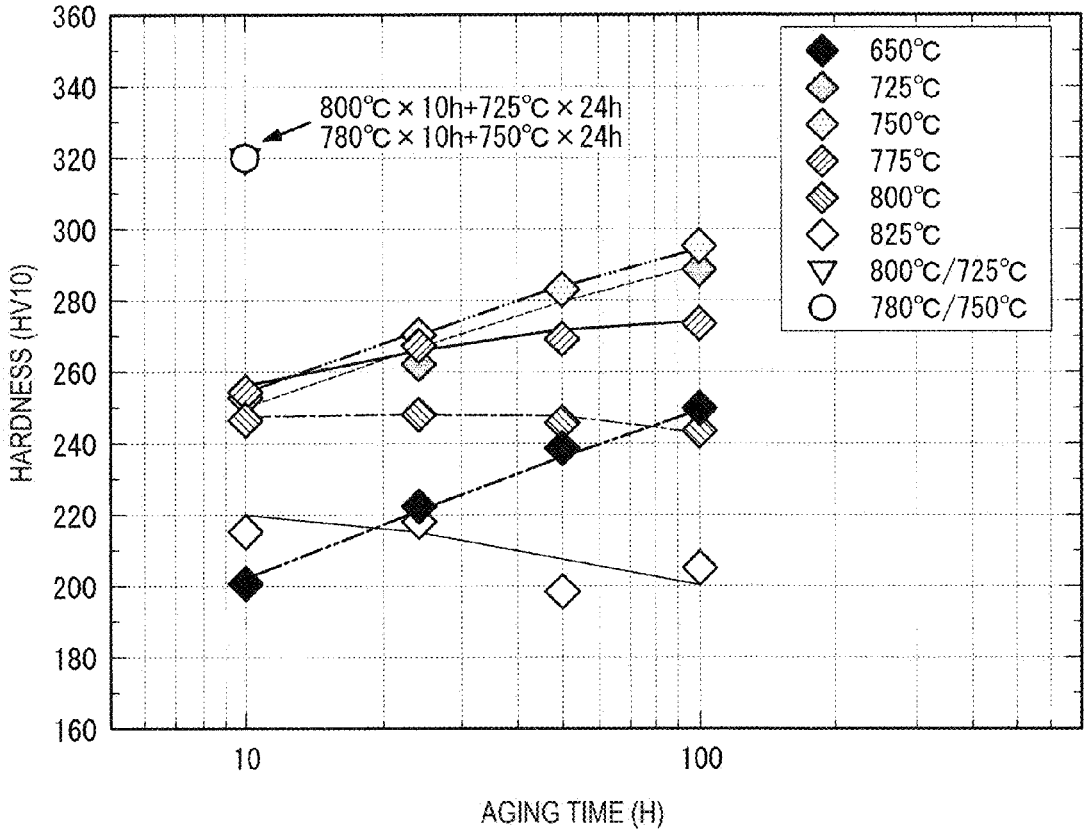
FIG. 1 is a drawing showing age-hardening curves in Examples of the invention.

The following will explain the contents defined in the present invention together with reasons for the limitation. Incidentally, the content of each component in the composition is shown in terms of % by mass. Moreover. "% by mass" and "% by weight" have the same meaning.

Alloy Composition

C: 0.005% to 0.10%

C is an additive element that forms carbides to suppress coarsening of crystal grains of an alloy and precipitates on the grain boundaries to improve high-temperature strength but, since a sufficient effect for improving the strength is not exhibited when the content is small, it is necessary to contain C in an amount of at least 0.005% or more. However, when the content is too large, there is a concern that the volume fraction of the other effective precipitated phases such as a γ' phase is lowered by excessive carbide formation or the susceptibility to hydrogen embrittlement is adversely affected, so that the upper limit is set at 0.10%. For the same reason, it is desirable to set the lower limit at 0.01% and the upper limit at 0.08%.

Si: 0.01% to 0.10%

Si is a component effective for deoxidation and the like and, in order to obtain the effect, it is necessary to contain it in an amount of at least 0.01% or more. However, since Si promotes the macrosegregation characteristics and is a constituent element of a precipitated phase harmful to the toughness and the susceptibility to hydrogen embrittlement, the upper limit of the content is set at 0.10%. For the same reason, it is desirable to set the lower limit at 0.01% and the upper limit at 0.08%.

P: 0.015% or Less

When P is excessively contained, there is a possibility that the segregation of P on the grain boundaries becomes excessive to lower the consistency of the grain boundaries and thus the effect of reducing the susceptibility to hydrogen embrittlement is lost. Therefore, the content of P is limited to 0.015% or less.

Moreover, in addition to the case where P is inevitably contained, P can be intentionally contained for the following reason. That is, when P is contained in an appropriate amount, it is considered that there is an effect of suppressing excessive accumulation of hydrogen on the grain boundaries and lowering the susceptibility to hydrogen embrittlement by increasing the consistency of the grain boundaries. In order to obtain the effect, it is necessary to contain P in an amount of 0.003% or more. Therefore, it is desirable to contain P in the range of 0.003 to 0.015%.

S: 0.003% or Less

The content of S is set at 0.003% that is industrially realizable, as an upper limit.

Ni: 23.0% to 27.0%

Ni is an austenite stabilization element and also is an element that becomes necessary for precipitating the γ' phase. However, when Ni is excessively contained, there is a concern that nickel hydride is formed, so that the lower limit of the content is set at 23.0% and the upper limit thereof is set at 27.0%. For the same reason, it is desirable to set the lower limit at 23.5% and the upper limit at 26.0%.

Cr: 12.0% to 16.0%

Cr is effective for improving corrosion resistance and oxidation resistance and also contributes the improvement of the high-temperature strength through carbide formation. However, since Cr causes the lowering of the toughness by the precipitation of α-Cr in the case where Cr is excessively contained, the lower limit of the content is set at 12.0% and the upper limit thereof is set at 16.0%. For the same reason, it is desirable to set the lower limit at 13.0% and the upper limit at 15.0%.

Mo: 0.01% or Less

Mo is effective for improving strength as a solid solution strengthening element and also is an element that suppresses the diffusion of the alloy elements to improve structural stability. On the other hand, since Mo is a constituent element of a harmful precipitated phase and also worsens the macrosegregation characteristics, the productivity of a large ingot is greatly lowered. Therefore, in the present invention, the content thereof is limited to 0.01% or less.

Nb: 0.01% or Less

Nb is an element that is effective for strength improvement through precipitation strengthening. However, on the other hand, since Nb is a constituent element of a harmful precipitated phase and also worsens the macrosegregation characteristics, the productivity of a large ingot is greatly lowered. Therefore, in the invention, the content thereof is limited to 0.01% or less.

The above-described S, Mo, and Nb are positioned as unavoidable impurities in the invention, so that it is not essential to contain them.

W: 2.5% to 6.0%

W is an element having effects similar to those of Mo and improves the structural stability together with solution strengthening but the influence on the deterioration of the macrosegregation characteristics, the formation of a harmful precipitated phase, and the like is small as compared with Mo. As a content effective for the structural stability, the lower limit value is set at 2.5%. On the other hand, when W is excessively added, there is a possibility of causing the lowering of the structural stability and the deterioration of the hot-workability resulting from the precipitation of an α-W phase and a Laves phase, so that the upper limit is set at 6.0%. For the same reason, it is desirable to set the lower limit at 3.0% and the upper limit at 5.5%.

Al: 1.5% to 2.5%

Al combines with Ni and Ti in the present alloy system to precipitate a γ' phase, thereby improving the high-temperature strength. Since an increase in the γ' phase volume ratio is required in order to attain high strength by the γ' phase, it is necessary to contain Al in an amount of 1.5% or more. However, when Al is excessively contained, there is a concern of coarse aggregation of the γ' phase on the grain boundaries or the deterioration of hot-workability, so that the upper limit of the content is set at 2.5%. For the same reason, it is desirable to set the lower limit at 1.7% and the upper limit at 2.3%.

Ti: 1.5% to 2.5%

Ti is an element constituting the γ' phase similarly to Al and is an element effective for strength improvement. It is necessary to increase the γ' phase volume ratio in order to improve the high-temperature strength and hence the Ti content is set at 1.5% or more in consideration of the balance with Al. However, since an excessive content thereof causes coarse aggregation of carbides to lower the toughness and also has an adverse influence on the susceptibility to hydrogen embrittlement, the upper limit is set at 2.5%. For the same reason, it is desirable to set the lower limit at 1.7% and the upper limit at 2.3%.

B: 0.0020% to 0.0050%. Zr: 0.02% to 0.05%

B is effective for high-temperature strength improvement through the segregation mainly on the crystal grain boundaries and can be contained as desired. However, since a borate is formed and makes the grain boundaries brittle when B is excessively contained, in the case where it is contained as desired, the lower limit of the content is set at 0.0020% and the upper limit thereof is set at 0.0050%. For the same reason, it is desirable to set the lower limit at 0.0025% and the upper limit at 0.0045%.

Zr is effective for high-temperature strength improvement through the segregation mainly on the crystal grain boundaries and can be contained as desired. However, since the hot-workability is lowered when Zr is excessively contained, in the case where it is contained as desired, the lower limit of the content is set at 0.025% and the upper limit thereof is set at 0.045%.

Metal Structure

η phase: not contained

γ' phase: volume ratio of 15% or more

In an Fe—Ni-based alloy, in the case where the η phase is precipitated, the toughness and the high-temperature characteristics are lowered and the susceptibility to hydrogen embrittlement is deteriorated. The η phase in the Fe—Ni-based alloy is precipitated through the diffusion of the intraparticle γ' phase that is metastable, resulting from elevated temperature holding. In order to suppress the precipitation of the η phase, it is effective to add Mo that has an effect of suppressing the diffusion. However, since Mo is an element that forms harmful precipitated phases such as Laves phases ($Fe_2$(Ti, Mo)) and an X phase ($Mo_5Cr_6Fe_{18}$), Mo is desirably not contained in order to improve the structural stability for a long time. In the present alloy, the precipitation of the harmful precipitated phases is prevented by restricting Mo to 0.01% or less in terms of % by mass and the precipitation of the η phase is suppressed by containing W that is effective similarly to Mo in an amount of 2.5 to 6.0% in terms of % by mass. Thereby, the η phase is not contained in the structure and the precipitation of the η phase can be avoided in the high-temperature and long-time use or precipitation initiation time can be shifted to a long time side.

Moreover, in order to improve the high-temperature strength, precipitation strengthening by a finely precipitated phase is effective but, since specific precipitated phases such as a σ phase and the Laves phase in addition to the aforementioned η phase increase the susceptibility to hydrogen embrittlement though the influence is small as compared with the η phase, these phases are desirably not contained. Therefore, in the present alloy, precipitation strengthening is performed only by the γ' phase that has small influence on the susceptibility to hydrogen embrittlement and is also effective for the improvement of the high-temperature strength. In order to obtain high strength only by the γ' phase, it is necessary to increase the volume ratio of the γ' phase. As a result of investigation, high-temperature strength more excellent than that of the conventional A286 steel is obtained when the γ' phase volume ratio is 15% or more.

When the volume ratio is less than 15%, the precipitation strength is insufficient and strength almost equal to that of A286 is only obtained.

As mentioned above, the γ' phase changes to the η phase through high-temperature long-time holding and it is known that the change is accelerated under a stress loading state. Since the susceptibility to hydrogen embrittlement greatly increases when the η phase is precipitated, in order to use the present alloy safely in a high-temperature and high-pressure environment and in a high-pressure hydrogen environment, these structural characteristic features should be maintained even in the case where the alloy is held at a high temperature for a long period of time.

Hydrogen Embrittlement Resistance Index (Reduction of Area Ratio in the Tensile Test at 625° C.: Hydrogen-Charged Material/As Material): 0.4 or More In the case where the alloy is used in a high-temperature and high-pressure hydrogen environment, it is surmised that hydrogen solves in the alloy during the use. For indicating the hydrogen embrittlement resistance in such a use situation, a hydrogen embrittlement resistance index is defined.

When the index is 0.4 or more, the alloy is judged to have good resistance to hydrogen embrittlement. When the index is less than 0.4, a decrease in reduction of area by hydrogen charging is large, so that it is judged that the resistance to hydrogen embrittlement is insufficient.

Incidentally, at the measurement of the hydrogen embrittlement resistance index, hydrogen is forcibly charged into the alloy by holding the material under a hydrogen environment at a high temperature under a high pressure using a high-temperature and high-pressure autoclave (hereinafter referred to as hydrogen charging). The hydrogen embrittlement resistance index at a high temperature can be determined by performing a tensile test of a hydrogen-charged material and a material as received, at 625° C.

The hydrogen charging is performed under the conditions of 450° C., 25 MPa, and 72 hours. By the hydrogen charging, about 60 ppm of hydrogen is added in terms of mass ratio.

Solution Treatment: 950° C. or Higher

The solution temperature is set at 950° C. or higher where a recrystallization structure is obtained. The upper limit of the solution temperature is not particularly defined but the treatment is carried out at a temperature where remarkable grain growth occurs or a temperature lower than the temperature (e.g., 1100° C. or lower).

Aging Heat Treatment Conditions

First stage: 700 to 800° C.

Second stage: 700 to 800° C. (provided that a temperature lower than the temperature at the first stage)

After the solution treatment, subsequently to the aging heat treatment at a first stage, by performing aging at a second stage at a temperature lower than the temperature at the first stage, the volume fraction of the γ' phase can be increased without coarsening the γ' phase that has precipitated at the first stage. As a result of investigating the age hardening behavior, most suitable aging temperature is between 700° C. and 800° C. and the highest strength is obtained by performing the aging between 700° C. and 800° C. at both of the first stage and the second stage. Incidentally, the aging heat treatment at the second stage is performed at a temperature lower than the temperature at the first stage.

When the temperature at the first stage and at the second stage is lower than 700° C., a peak of hardness exists at a long time side and thus sufficient hardness is not obtained within a practical time range. When the temperature at the first stage and at the second stage is higher than 800° C., the hardness decreases owing to over aging.

Incidentally, the aging heat treatment may be performed by cooling the alloy after the solution treatment and subsequently heating it or the aging heat treatment may be performed by keeping a temperature in the middle of cooling after the solution treatment.

0.0020% to 0.0050% and Zr: 0.02% to 0.05% as desired, the balance being Fe and other unavoidable impurities. The Fe—Ni-based alloy of the invention can be melted by usual methods and the method for melting is not particularly limited in the invention. In the above composition, for example, a large ingot having more than 10 tons can be produced without causing the macroscopic segregation problem.

The Fe—Ni-based alloy can be subjected to processing such as forging as desired and also can be subjected to a solution treatment and a heat treatment by aging.

The solution treatment can be performed, for example, under conditions of 950° C. to 1100° C. and 1 to 20 hours.

Moreover, the aging heat treatment is desirably a two-stage treatment within a temperature range of 700 to 800° C. at each stage, the temperature at the second stage being lower than the temperature at the first stage. By adopting the conditions, tensile strength of 900 MPa or more in the tensile strength test at 625° C. and reduction of area of 25% or more can be secured.

Incidentally, when the former temperature is lower than 650° C. or higher than 825° C., the γ' phase cannot sufficiently grow and the above tensile strength cannot be secured.

The Fe—Ni-based alloy obtained above can be suitably utilized for power generation plants, jet engine materials, and the like to be used under a high-temperature and high-pressure environment of 600° C. or higher.

EXAMPLES

Examples 1 to 5 and Comparative Examples 1 to 4

The following will describe Examples of the invention.

Fe—Ni-based alloys of Examples and Comparative Examples are melted with the compositions (the balance being Fe and unavoidable impurities) shown in Table 1. Incidentally, Comparative Example 1 has a composition of common A286 alloy.

A test material having a composition of Table 1 was melted in a vacuum melting furnace and, after a diffusion heat treatment at 1200° C., a forged plate having a thickness of 35 mm was made by hot forging.

TABLE 1

(mass %)

| Test material | | C | Si | Mn | P | S | Ni | Cr | Mo | Al | Ti | W | Nb | Zr | B | Fe |
|---|---|---|---|---|---|---|---|---|---|---|---|---|---|---|---|---|
| Example | 1 | 0.011 | 0.02 | 0.01 | 0.003 | <0.0003 | 24.7 | 13.6 | 0.01 | 1.82 | 1.94 | 4.83 | <0.01 | 0.03 | 0.004 | Bal. |
| | 2 | 0.007 | 0.02 | 0.01 | 0.011 | <0.0003 | 24.4 | 14.1 | 0.01 | 1.79 | 1.89 | 4.84 | <0.01 | <0.005 | 0.003 | Bal. |
| | 3 | 0.042 | 0.02 | 0.01 | 0.012 | <0.0003 | 24.6 | 14.1 | 0.01 | 1.81 | 1.95 | 4.96 | <0.01 | <0.005 | 0.003 | Bal. |
| | 4 | 0.008 | 0.02 | 0.01 | 0.004 | <0.0003 | 24.4 | 14.1 | 0.01 | 1.80 | 1.88 | 4.86 | <0.01 | <0.005 | 0.003 | Bal. |
| | 5 | 0.007 | 0.02 | 0.01 | <0.003 | <0.0003 | 24.4 | 14.0 | 0.01 | 1.79 | 1.90 | 4.85 | <0.01 | <0.005 | <0.001 | Bal. |
| Comparative Example | 1 | 0.017 | 0.47 | 0.01 | <0.003 | 0.0003 | 25.1 | 14.0 | 1.25 | 0.20 | 2.33 | <0.01 | <0.01 | <0.005 | 0.004 | Bal. |
| | 2 | 0.017 | 0.02 | 0.01 | <0.003 | 0.0003 | 25.0 | 14.2 | 0.01 | 1.78 | 1.91 | <0.01 | <0.01 | 0.03 | 0.004 | Bal. |
| | 3 | 0.010 | 0.02 | 0.01 | <0.003 | 0.0003 | 24.8 | 13.9 | 0.01 | 1.80 | 1.91 | 2.45 | <0.01 | 0.04 | 0.004 | Bal. |
| | 4 | 0.012 | 0.02 | 0.01 | <0.003 | 0.0003 | 24.5 | 14.0 | 0.01 | 1.79 | 1.92 | 7.44 | <0.01 | <0.005 | 0.003 | Bal. |

The following will describe one example of the embodiment of the invention.

The Fe—Ni-based alloy of the invention is prepared so as to have a composition containing, in terms of % by mass, C: 0.005% to 0.10%, Si: 0.01% to 0.10%, P: 0.015% or less (preferably 0.003 to 0.015%), S: 0.003% or less, Ni: 23.0% to 27.0%, Cr: 12.0% to 16.0%, Mo: 0.01% or less, Nb: 0.01% or less, W: 2.5% to 6.0%, Al: 1.5% to 2.5%, and Ti: 1.5% to 2.5% and further containing one or two kinds of B:

With regard to the heat treatment conditions, most suitable solution conditions and aging conditions were investigated. Table 2 shows the relationship between the heat treatment conditions and the hardness and FIG. 1 shows age-hardening curves. HV10 in the Table indicates Vickers hardness at a load of 10 kg.

A recrystallization structure was obtained at a solution temperature of 980° C. and the hardness after aging was a value equal to that of a solution-treated material at 1060° C.

With regard to the aging heat treatment conditions, it is realized that high hardness is obtained within a practical time range by performing the aging treatment in the range of 700° C. to 800° C. When the temperature exceeds 800° C., the hardness decreases owing to over aging and, when it is lower than 700° C., since a peak of hardness exists at a long time side, sufficient hardness is not obtained within a practical time range.

TABLE 2

| Test material | Heat treatment conditions: Solution treatment | Heat treatment conditions: Aging heat treatment | Hardness (HV10) |
|---|---|---|---|
| Example 1 | 980° C. × 3 hours | 780° C. × 10 hours + 750° C. × 24 hours | 323 |
| | 1060° C. × 3 hours | 725° C. × 24 hours + 650° C. × 16 hours | 285 |
| | | 780° C. × 10 hours + 750° C. × 24 hours | 321 |

Figure 2:
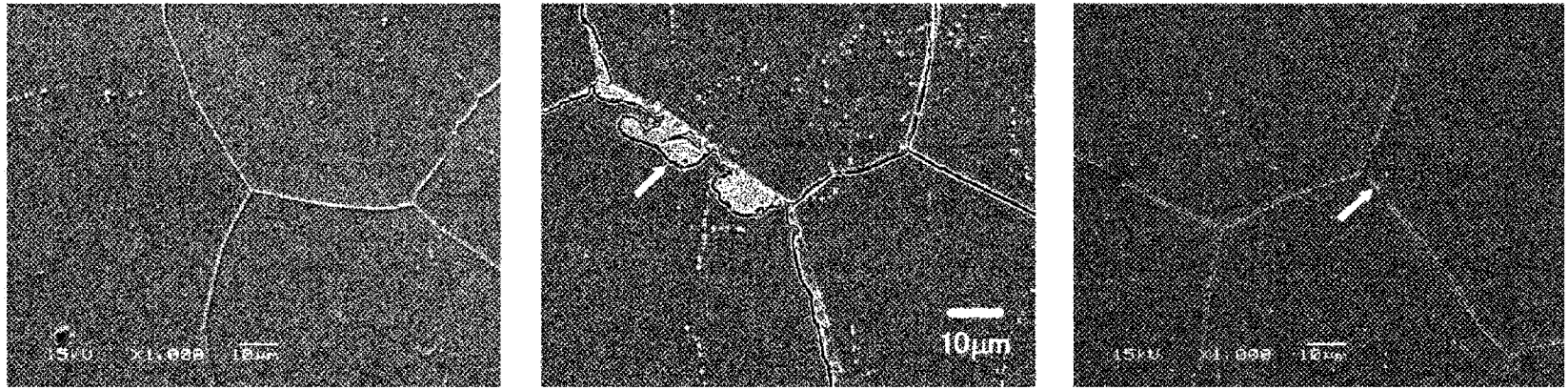
FIGS. 2(*a*) to 2(*c*) are photographs substituted for drawings obtained by scanning microscope observation, which show microstructures of test materials after a solution heat treatment and an aging heat treatment.

Then, structural observation after the solution heat treatment and the aging heat treatment was carried out. FIGS. 2(*a*) to 2(*c*) show microstructures on SEM observation for Example 1 and Comparative Examples 2 and 3. In all alloys, the treatments were carried out under heat treatment conditions where the hardness became maximum hardness. In Comparative Example 2 where no W is contained, a large number of the η phases are observed on the grain boundaries (the portion indicated by an arrow). Also, in Comparative Example 3 where W is contained in an amount of 2.45% by mass, the η phase is observed on the grain boundaries though the precipitation amount is smaller than that in Comparative Example 2 (the portion indicated by an arrow). In Example 1, the precipitation of the η phase was not observed on the grain boundaries. Therefore, it is judged that W should be contained in an amount of 2.5% by mass or more for suppressing the precipitation of the η phase.

Table 3 shows precipitated phases in the case where the test materials are held at 650° C. Since the test for evaluating long-time structural stability requires a huge amount of time, the γ' phase volume ratio and the precipitated phases upon long-time and elevated temperature holding were determined by a thermodynamic calculation program (Thermo-Calc Software AB, Thermo-Calc version S) in which an equilibrium state can be predicted. Since it is surmised that the η phase is not contained even when the material reaches an equilibrium state by the long-time and elevated temperature holding in the case of Example 1 where the volume ratio of the γ' phase is 15% or more, it is expected that a change in material characteristics is small. On the other hand, it is surmised that the η phase is precipitated in Comparative Examples 1 and 3, and it is surmised that the Laves phase is precipitated in Comparative Example 4, so that it is expected that the material characteristics are deteriorated in both cases. Incidentally, in the prediction results by the above program, including Example 1, the precipitation of a small amount of the σ phase (volume ratio of less than 5%) is predicted but, in Example 1, the η phase is not precipitated and satisfactory material characteristics are maintained even upon the long-term and elevated temperature holding.

TABLE 3

| Test material | | γ phase volume ratio (%) | Other precipitated phases |
|---|---|---|---|
| Example 1 | | 20 | σ |
| Comparative Example | 1 | 3 | η, σ |
| | 3 | 18 | η, σ |
| | 4 | 17 | σ, Laves |

Table 4 shows results of the tensile test at a high temperature. With assuming a case of the use in a high-temperature environment, the test temperature was set at 625° C. Incidentally, as the heat treatment conditions, the test was carried out under conditions where the hardness of each alloy became maximum hardness. In Table 4, 0.2% Y.S. and T.S. are results of the tensile test in accordance with JIS G0567. In Examples 1 to 4, higher strength is obtained in the tensile test at 625° C. as compared with the cases of Comparative Examples 1 and 3 and also, as for elongation and reduction of area, values having no problem in practical use are obtained. Particularly, as compared with Comparative Example 1 that is a material equal to A286, strength is greatly improved in Examples.

TABLE 4

| Test material | | Tensile test temperature (° C.) | 0.2% Y.S. (MPa) | TS. (MPa) | Elongation (%) | Reduction of area (%) |
|---|---|---|---|---|---|---|
| Example | 1 | 625 | 682 | 929 | 22 | 41 |
| | 2 | | 698 | 927 | 17 | 45 |
| | 3 | | 716 | 949 | 18 | 45 |
| | 4 | | 697 | 935 | 17 | 31 |
| | 5 | | 677 | 934 | 19 | 33 |
| Comparative Example | 1 | 625 | 618 | 884 | 30 | 55 |
| | 3 | | 681 | 892 | 20 | 41 |

Figure 3:
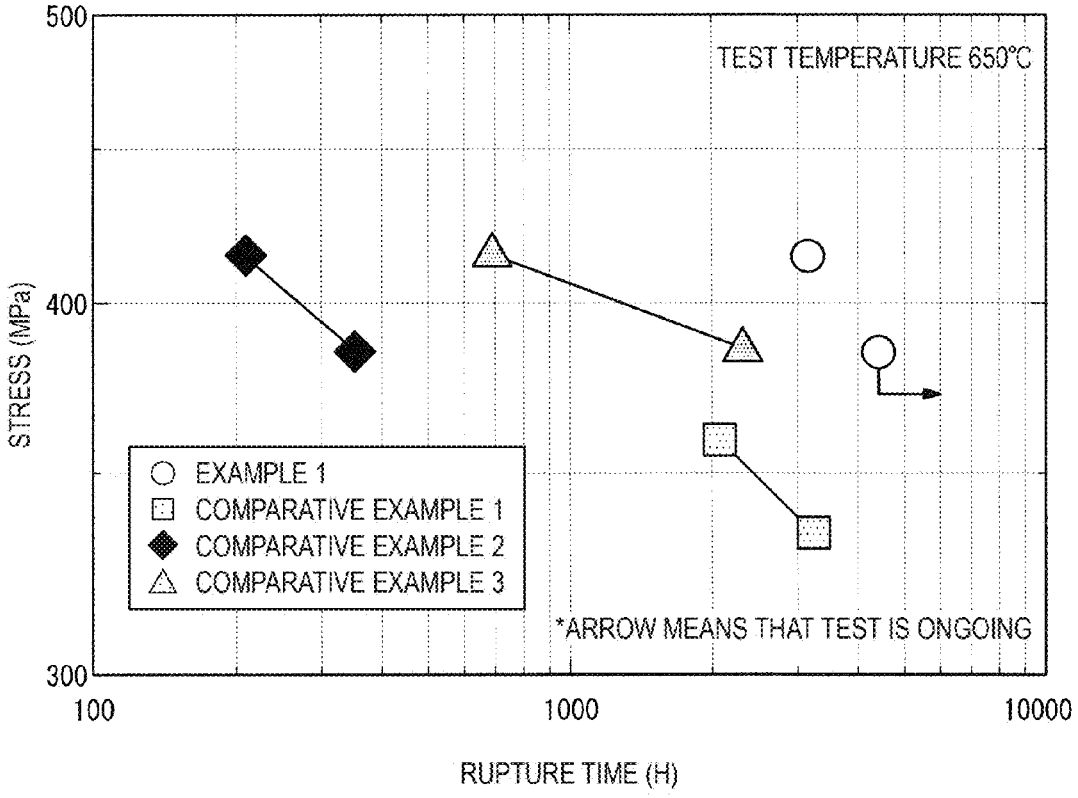
FIG. 3 is a drawing showing creep test results of Example 1 and Comparative Examples 1 to 3.

FIG. 3 shows results of a creep rupture test. As shown in FIG. 2, in Comparative Examples 2 and 3 where the η phase was precipitated, a rupture was caused with a short period of time as compared with the case of Example 1 and thus a decrease in high-temperature characteristics caused by the precipitation of the η phase was observed. Particularly in Comparative Example 3, although the tensile strength at 625° C. is equal to that of Examples, the creep rupture time is shortened by 2000 hours or more as compared to the case of Example 1. Thus, it is obvious from the result that the creep characteristics are remarkably deteriorated when the η phase is precipitated. In Comparative Example 1, the precipitation of the η phase was not observed but the creep strength is lower than that of Example 1, so that an increase in thickness may be invited, for example, in the case of the use as a pressure vessel.

Then, a tensile test of the hydrogen charged material was carried out. The hydrogen charging was carried out using a high-temperature and high-pressure autoclave and a test specimen was held under a hydrogen gas atmosphere of 450° C. and 25 MPa for 72 hours. After the hydrogen charging, hydrogen concentration of the test specimen was measured and it was confirmed that about 60 ppm of hydrogen was added in terms of mass ratio.

Figure 4:
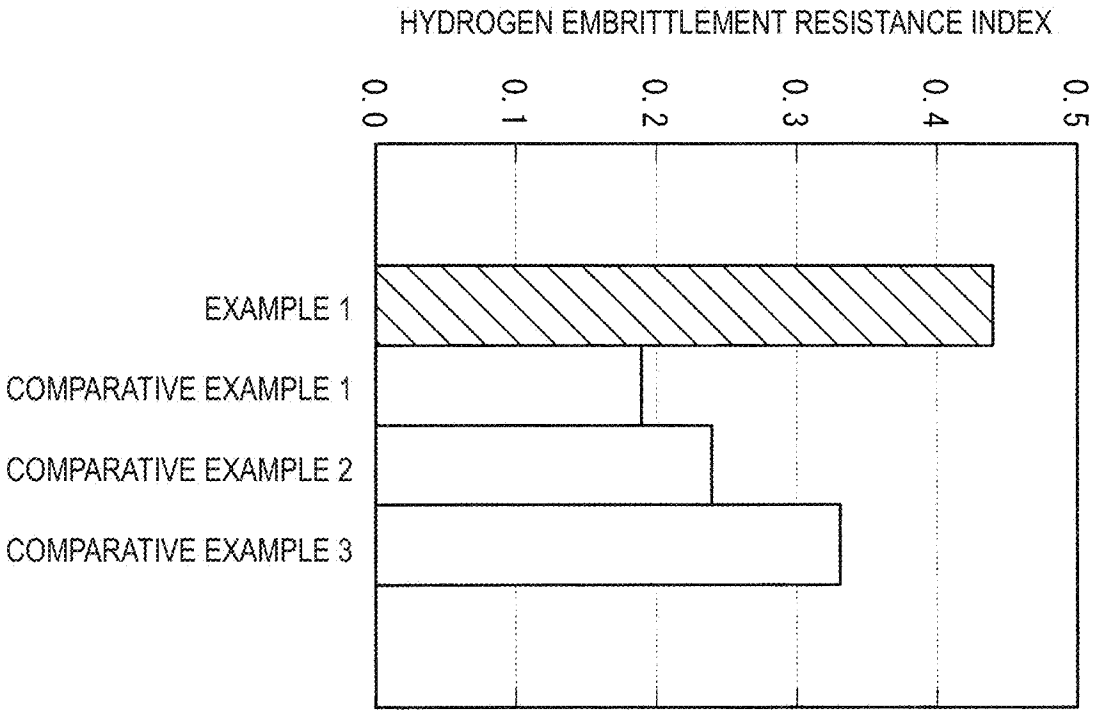
FIG. 4 is a drawing showing tensile test results on the hydrogen charged materials of Example 1 and Comparative Examples 1 to 3.

The tensile test was carried out in the atmospheric air and carried out at a test temperature of 625° C. at a rate that corresponded to a strain rate of $2\times10^{-5}$. FIG. 4 shows hydrogen embrittlement resistance indices of the hydrogen charged materials and the materials as received, the indices being determined by the tensile test at 625° C. It was confirmed that the hydrogen embrittlement resistance index was large in Example 1 as compared with Comparative Examples. Particularly, it was confirmed that the hydrogen embrittlement resistance was greatly improved in Example 1 as compared with Comparative Example 1 that was a material equal to A286. In Example 1, in addition to the suppression of precipitation of the η phase, since the γ' phase finely dispersed in the grains acts as a trapping site of hydrogen, the degree of embrittlement caused by hydrogen can be reduced.

While the invention has been described in detail and with reference to specific embodiments thereof, it will be apparent to one skilled in the art that various changes and modifications can be made therein without departing from the spirit and scope thereof. The present application is based on Japanese Patent Application No. 2012-288610 filed on Dec. 28, 2012, and the contents are incorporated herein by reference.

The invention claimed is:

1. An Fe—Ni-based alloy, which has a composition consisting of, in terms of % by mass, C: 0.005% to 0.10%, Si: 0.01% to 0.10%, P: 0.015% or less, S: 0.003% or less, Ni: 23.0% to 27.0%, Cr: 12.0% to 16.0%, Mo: 0.01% or less, Nb: 0.01% or less, W: 3.0% to 6.0%, Al: 1.5% to 2.5%, Ti: 1.5% to 2.5%, and optionally one or both of B: 0.0020% to 0.0050% and Zr: 0.02% to 0.05%;

the balance being Fe and other unavoidable impurities; and wherein the alloy does not contain an η phase and contains 15% or more of a γ' phase in terms of a volume ratio in the metal structure.

2. The Fe—Ni-based alloy according to claim 1, wherein the alloy contains P: 0.003% to 0.015% in terms of % by mass.

3. The Fe—Ni-based alloy according to claim 1, wherein the composition further contains at least one of B: 0.0020% to 0.0050% and Zr: 0.02% to 0.05%.

4. The Fe—Ni-based alloy according to claim 1, wherein, in a tensile test at 625° C., a hydrogen embrittlement resistance index is 0.4 or more.

5. An Fe—Ni-based alloy, which has a composition consisting essentially of, in terms of % by mass, C: 0.005% to 0.10%, Si: 0.01% to 0.10%, P: 0.015% or less, S: 0.003% or less, Ni: 23.0% to 27.0%, Cr: 12.0% to 16.0%, Mo: 0.01% or less, Nb: 0.01% or less, W: 4.83% to 6.0%, Al: 1.5% to 2.5%, Ti: 1.5% to 2.5%, and optionally one or both of B: 0.0020% to 0.0050% and Zr: 0.02% to 0.05%;

the balance being Fe and other unavoidable impurities; and wherein the alloy does not contain an η phase and contains 15% or more of a γ' phase in terms of a volume ratio in the metal structure.

* * * * *